US007311376B2

(12) United States Patent
Gast et al.

(10) Patent No.: US 7,311,376 B2
(45) Date of Patent: Dec. 25, 2007

(54) IMAGING DEVICE AND METHOD

(75) Inventors: Paul D. Gast, Camas, WA (US); John A. Barinaga, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 300 days.

(21) Appl. No.: 10/947,482

(22) Filed: Sep. 22, 2004

(65) Prior Publication Data

US 2006/0061619 A1 Mar. 23, 2006

(51) Int. Cl.
*B41J 2/165* (2006.01)

(52) U.S. Cl. ..... 347/33; 347/32

(58) Field of Classification Search ..... 347/22–24, 347/28, 29–33, 35
See application file for complete search history.

(56) References Cited

U.S. PATENT DOCUMENTS 4,369,456 A 1/1983 Cruz-Uribe
4,853,717 A 8/1989 Harmon
4,933,015 A 6/1990 White
4,947,190 A 8/1990 Mizusawa
5,040,000 A 8/1991 Yokoi
5,081,472 A * 1/1992 Fisher ..... 347/33
5,103,244 A 4/1992 Gast
5,115,250 A 5/1992 Harmon
5,146,243 A 9/1992 English
5,155,497 A 10/1992 Martin
5,184,147 A 2/1993 MacLane
5,206,668 A 4/1993 Lo
5,250,962 A 10/1993 Fisher
5,300,958 A 4/1994 Burke
5,315,316 A 5/1994 Khormaee
5,589,865 A 12/1996 Beeson
5,602,577 A 2/1997 Shibata
5,617,125 A 4/1997 Chew
5,719,602 A 2/1998 Hackleman
5,734,394 A 3/1998 Hackleman
5,742,305 A 4/1998 Hackleman
5,745,133 A 4/1998 Kendricks
5,886,714 A 3/1999 Burney
5,917,528 A * 6/1999 Grellmann et al. ..... 347/88
5,943,067 A 8/1999 Kong
5,984,450 A 11/1999 Becker
6,102,518 A 8/2000 Taylor
6,113,216 A 9/2000 Wong (Continued)

FOREIGN PATENT DOCUMENTS

DE 3817754 11/1989

(Continued)

OTHER PUBLICATIONS

DE3817754, Concise Explanation of Relevance of Document not in the English Language.

(Continued)

*Primary Examiner*—Shih-Wen Hsieh
(74) *Attorney, Agent, or Firm*—Robert D. Wasson

(57) ABSTRACT

An imaging device is disclosed that includes a drum platen having a recess. A loading mechanism for loading an absorber into the recess and a pen is configured to eject ink on the absorber while the absorber is in the recess.

38 Claims, 5 Drawing Sheets

U.S. PATENT DOCUMENTS

| | | | | |
|---|---|---|---|---|
| 6,123,410 | A | 9/2000 | Beerling | |
| 6,135,585 | A | 10/2000 | Johnson | |
| 6,154,232 | A | 11/2000 | Hickman | |
| 6,155,667 | A | 12/2000 | Eckard | |
| 6,179,419 | B1 | 1/2001 | Rasmussen | |
| 6,193,357 | B1 | 2/2001 | Medin | |
| 6,224,186 | B1 | 5/2001 | Johnson | |
| 6,250,736 | B1 | 6/2001 | Wojcik | |
| 6,250,738 | B1 | 6/2001 | Waller | |
| 6,318,920 | B1 * | 11/2001 | Silverbrook | 400/653 |
| 6,328,411 | B1 | 12/2001 | Taylor | |
| 6,341,845 | B1 | 1/2002 | Scheffelin | |
| 6,389,241 | B1 | 5/2002 | Cernusak | |
| 6,402,290 | B1 | 6/2002 | Johnson | |
| 6,409,304 | B1 | 6/2002 | Taylor | |
| 6,464,327 | B1 | 10/2002 | Eckard | |
| 6,467,874 | B1 | 10/2002 | Williams | |
| 6,663,215 | B2 * | 12/2003 | Klausbruckner et al. | 347/22 |
| 6,809,047 | B2 * | 10/2004 | Lebold et al. | 442/392 |
| 6,896,349 | B2 * | 5/2005 | Valero et al. | 347/22 |
| 6,932,455 | B2 * | 8/2005 | Monclus et al. | 347/22 |
| 2003/0137581 | A1 | 7/2003 | Kerr | |

FOREIGN PATENT DOCUMENTS

| | | | |
|---|---|---|---|
| EP | 0589604 | | 3/1994 |
| GB | 2218049 | | 11/1989 |
| GB | 2238510 | | 6/1991 |
| JP | 59115863 | * | 4/1984 |

OTHER PUBLICATIONS

USSN 10/426574, Monclus et al., Printing Apparatus and Method, Apr. 30, 2003.

USSN 10/700129. Tanner et al, Drum Printer With Spittoon and Method for Servicing, Nov. 3, 2003.

* cited by examiner

IMAGING DEVICE AND METHOD

BACKGROUND

Inkjet pens are often serviced by performing spitting to remove blockages. Servicing such pens during printing can be time consuming and may limit throughput.

DETAILED DESCRIPTION

Figure 1:
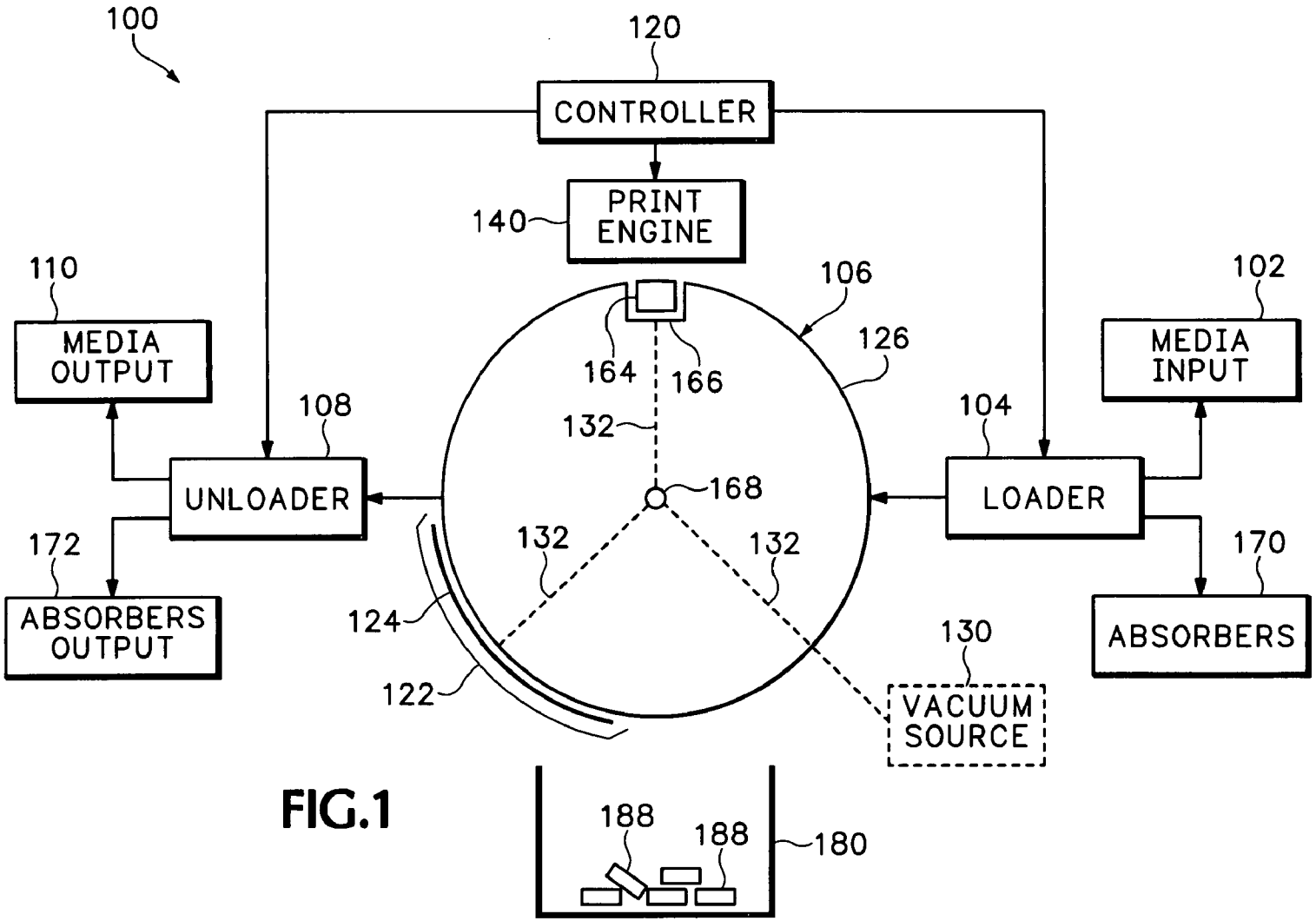
FIG. 1 illustrates a portion of an example imaging device in accordance with an example embodiment.

FIG. 1 illustrates a portion of an example imaging device 100 in accordance with an example embodiment. The device 100 is shown as generally including a media input 102, a loader 104, a drum 106, an unloader 108, and a media output 110. The media input 102 may comprise a tray or other structure configured to store media, such as a stack of paper sheets, and to present the media to the loader 104 for loading onto the drum 106.

The loader 104 may comprise any of a variety of suitable media handling devices configured to advance media from the media input 102 to the drum 106. For example, the loader 104 may comprise a pick roller (not shown), configured to pick media and advance the media through other rollers, belts, or both, to move the media from the media input 102 to the drum 106. The loader 104 is shown as operating under influence of a controller 120. The controller 120 controls the rotational speed of the drum and monitors the angular position of the drum 106. The controller 120 also controls advancement of media through the loader 104 and monitors the location or position of the media as the media passes through the loader 104. Thus, the loader 104, operating under control of the controller 120 may accurately position media on the drum 106. In some embodiments, the drum 106 includes a media region 122 at which a sheet 124 of media to be imaged is typically positioned. In some embodiments, the loader 104 may be configured in a manner similar to media handling devices that feed media to a platen from multiple media sources, such as different paper input trays.

The sheet 124 of media to be imaged is maintained on a surface 126 of the drum 106 during imaging. The sheet 124 of media to be imaged may be maintained at the surface 126 by suction force created by an optional vacuum source 130 and vacuum conduits 132. Alternatively, the sheet 124 may be maintained on the drum 106 by protrusions on the surface 126 (not shown). In other embodiments, the sheet 124 may be maintained on the drum 106 by electrostatic attraction or electrostatic hold down.

The sheet 124 may be unloaded from the drum 106 by the unloader 108. In some embodiments, the unloader 108 is configured to strip or otherwise separate the sheet 124 from the drum 106 and to then advance the sheet 124 to the media output 110. The unloader 108 may operate under control of the controller 120 to remove the sheet 124 from the drum 106 after the sheet 124 has been at least partially imaged by print engine 140 and to then route the sheet 124 to the media output 110. The unloader 108 may comprise a set of rollers, belts, diverters or the like for advancing the sheet 124 from the drum to the media output 110. In some embodiments, the unloader 108 may include protrusions (not shown), such as claws or fingers, that selectively extend to the surface of the drum to assist in separating the sheet 124 from the drum. These protrusions may be cam-driven and to move in accordance with the angular position of the drum.

The print engine 140 may comprise an inkjet print engine having one or more pens. Each pen may have one or more print heads. In some embodiments, different colors of ink may be present the different print heads. For example, the print engine 140 may comprise a page-wide array of print heads or may comprise one or more print heads configured to move during printing.

The drum 106 is also shown as including an absorber 164 disposed in a recess 166. The recess 166 may be formed in the surface 126 of the drum 106. In some embodiments, the recess 166 is elongated recess having a longitudinal axis parallel with the axis of rotation 168 of the drum 106. While the recess 166 may have a substantially rectangular cross-section, as shown in FIG. 1, the cross-sectional shape of the recess 166 may be different in other embodiments.

The absorber 164 may comprise a foam, sponge, porous, fibrous, or other material suitable for absorbing, or maintaining, ink spit thereon by the print engine 140. In some embodiments, the absorber 164 is formed of an absorbent material that pulls ink spit thereon deep into the absorber by wicking.

The absorber 164 may be maintained in the recess 166 by grippers (not shown), by a light adhesive disposed between a bottom surface of the recess 166 and the absorber 164, by suction via the conduits 132, or other suitable manner. In embodiments where the absorber 164 is maintained in the recess 166 by suction, it may be satisfactory to rotate the drum to position the recess 166 at a top of the drum when power is off to prevent the absorber 164 from falling out of the recess 166.

In this configuration, the print engine 140 may perform a servicing operation, such as spitting, without moving away from the drum surface 126. Operating under control of the controller 120, the print engine 140 may spit ink onto the absorber 164. As discussed below, the absorber 164 may be periodically replaced with a clean absorber or an absorber having less ink thereon. In some embodiments, the replacement interval is chosen such that the absorber 164 is removed and replaced with another absorber before saturation of the absorber 164 with ink or after a predetermined amount of ink has been spit on the absorber 164.

The device 100 is shown as including a supply of absorbers 170. Each of the absorbers in the supply of absorbers 170 may be configured similar or identical to the absorber 164 disposed in the recess 166. The unloader 108 is configured to remove the absorber 164 from the recess 166 and to advance the absorber 170 to the absorber output 172. In this configuration, the same unloader 108 that removes the sheet 124 and advances the sheet to the media output 110 also removes the absorber 164 and advances the removed absorber 164 to the absorber output 172, which may comprise an output bin. The unloader 108 may be configured in a manner similar to other media handling devices that route media to different output bins based on signals received from a controller. In some embodiments, the controller 120 may reduce the rotational speed of the drum during loading and unloading the absorber 164.

Alternatively, the absorber 164 may be removed from the drum 106 by rotating the drum 106 such that the recess 166 is at or near a bottom portion of the drum (i.e., oriented at about −90 degrees from horizontal). With the drum 106 in this position, a receptacle 180 is positioned directly below, or in a direction of gravity, from the absorber 164 and recess 166. In this position, the absorber 164 may be removed from the drum 106 by force of gravity. Pursuant to an example embodiment, the controller 120 causes the drum 106 to position the recess 166 directly above the receptacle 180 and then decreases or terminates the suction applied to the recess 166 via the conduits 132. With the reduced suction, the force of gravity pulls the absorber 164 from the recess 166 into the receptacle 180. The absorber 164 falls into the receptacle 166 by gravity with the suction force reduced or terminated. Used absorbers 188 are shown as being disposed in the receptacle 180.

As such, FIG. 1 illustrates at least two alternative ways in which the absorber 164 may be removed from the drum 106. One way is for the controller 120 to cause the unloader 108 to strip the absorber 164 from the drum 106 and to then advance the stripped absorber into the absorbers output 172. The other way is for the controller 120 to position the drum 106 such that the absorber 164 is at the bottom of the drum and directly over the receptacle 180 and then reducing or terminating the suction force to permit the absorber 164 to drop from the drum 106 into the receptacle by gravity.

In embodiments where grippers maintain the absorber 164 in the recess 166, the grippers may be opened under control of the controller 120 to release the absorber 164 and to allow the absorber to fall into the receptacle 180. Alternatively, an actuator may be provided to push or otherwise advance the absorber 164 from the grip of the grippers so the absorber may fall into the receptacle 180.

In some embodiments, a technician or user may periodically or occasionally empty the absorbers output 172, the receptacle 180, or both, to prevent these from becoming too full. The technician or user may also restock or refill the supply of absorbers 170 with additional absorbers at this same or a similar interval.

Figure 2:
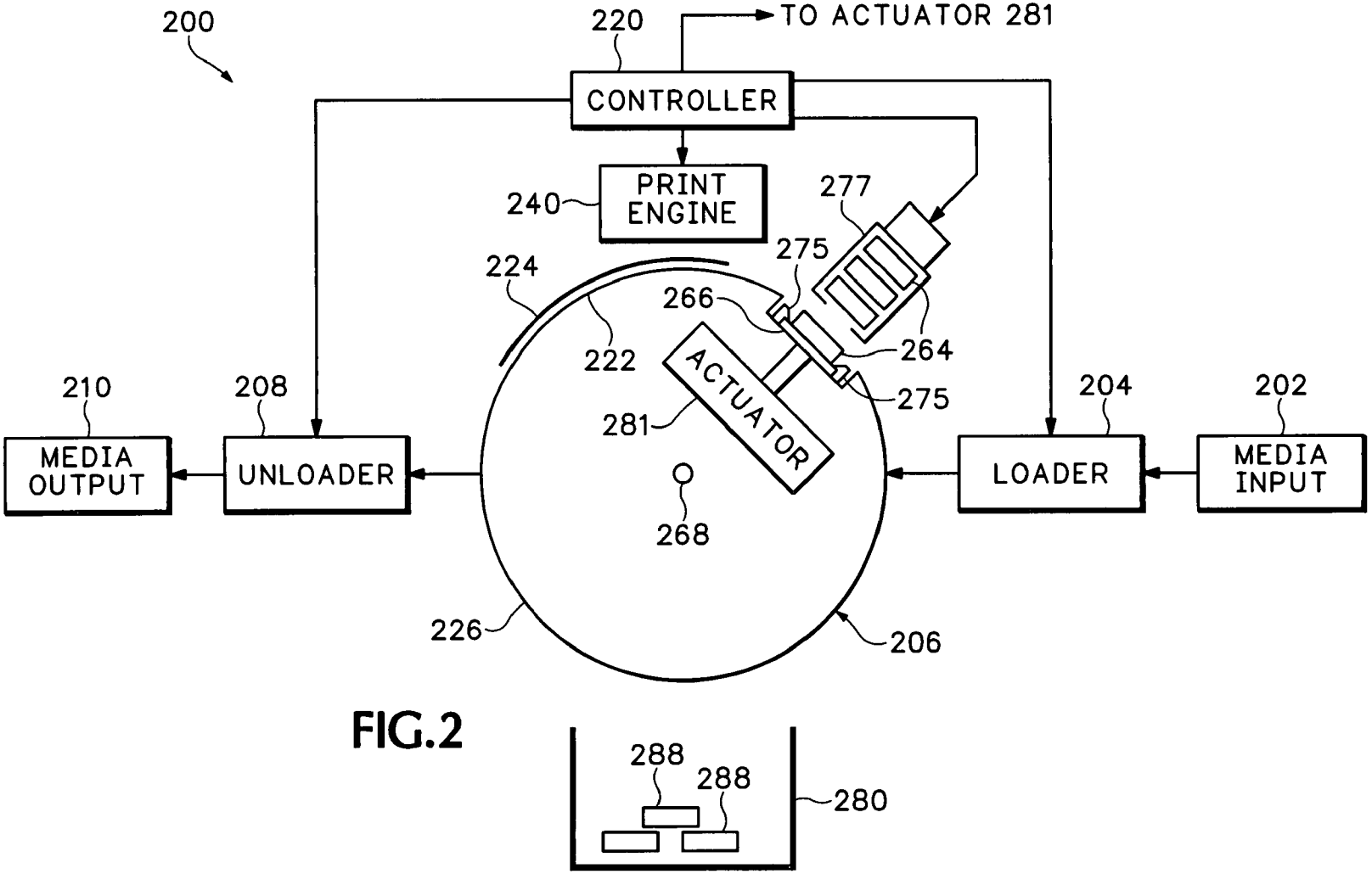
FIG. 2 illustrates a portion of another example imaging device in accordance with an example embodiment.

FIG. 2 illustrates a portion of another example imaging device 200 in accordance with an example embodiment. Similar to the embodiment of FIG. 1, the device 200 includes a media input 202, a loader 204, a drum 206, an unloader 208, and a media output 210. The media input 202 may comprise a tray or other structure configured to store media, such as a stack of paper sheets and to present the media to the loader 202 for loading onto the drum 206.

The loader 204 may comprise any of a variety of suitable media handling devices configured to advance media from the media input 202 to the drum 206. The loader 204 is shown as operating under influence of a controller 220. The controller 220 controls the rotational speed of the drum 206 and monitors the angular position of the drum 206. The controller 220 also controls advancement of media through the loader 204 and monitors the location or position of the media as the media passes through the loader 204. Thus, the loader 204, operating under control of the controller 220 may accurately position media on the drum 206. In some embodiments, the drum 206 includes a media region 222 at which a sheet 224 of media to be imaged is typically positioned. The sheet 224 may be maintained on the drum 206 by suction, by protrusions (not shown) on surface 226, by electrostatic hold down, or other suitable technique.

The sheet 224 may be unloaded from the drum 206 by the unloader 208. In some embodiments, the unloader 208 is configured to strip or otherwise separate the sheet 224 from the drum 206 and to then advance the sheet 224 to the media output 210. The unloader 208 may operate under control of the controller 220 to remove the sheet 224 from the drum 206 after the sheet 224 has been at least partially imaged by print engine 240 and to then route the sheet 224 to the media output 210. The unloader 208 may comprise a set of rollers, belts, diverters or the like for advancing the sheet 224 from the drum to the media output 210. The print engine 240 may be configured in a manner similar or identical to the print engine 140 described above.

In some embodiments, the unloader 208 may include protrusions (not shown), such as claws or fingers, that selectively extend to the surface of the drum to assist in separating the sheet 224 from the drum. These protrusions may be cam-driven and to move in accordance with the angular position of the drum.

The drum 206 is also shown as including an absorber 264 disposed in a recess 266. The recess 266 may be formed in the surface 226 of the drum 206. In some embodiments, the recess 266 is an elongated recess having a longitudinal axis parallel with the axis of rotation 268 of the drum 206. While the recess 266 may have a rectangular cross-section, as shown in FIG. 2, the cross-sectional shape of the recess 266 may be different in other embodiments.

The absorber 264 may be configured similar or identical to the absorber 164 described above. The absorber 264 may be suitable for absorbing, or maintaining, ink spit thereon by the print engine 240.

The absorber 264 may be maintained in the recess 266 by one or more grippers 275. The absorber 264 may be loaded into the grippers 275 manually in some embodiments. In other embodiments, the absorber 264 is loaded into the grippers 275 by feeder 277. The feeder 277 may be configured as a mechanical parts feeder and may comprise any suitable parts feeder, such as a pneumatic parts feeder, a solenoid driven parts feeder, a motor-driven parts feeder, a programmable parts feeder, or the like. The feeder 277 is configured to store absorbers 264 therein and to feed one or more of the stored absorbers 264 into the recess 266 under control of the controller 220.

In some embodiments, the grippers 275 operate under control of the controller 220 to move between open and closed positions to, respectively, release and retain the absorber 264 disposed in the recess 266. Pursuant to other embodiments, the grippers 275 do not operate under control of the controller 220, but rather comprise clips or retaining members and may passively retain the absorber 264 within the recess 266. In some embodiments, the grippers 275 maintain the absorber 264 within the recess 266 by spring force or other suitable force.

The feeder 277 may load one or more of the stored absorbers 264 into the recess by pushing one or more of the stored absorbers 264 into a tight, compression fit between the grippers 275. An actuator 281 may be positioned at the drum 206 and may operate under control of the controller 220. In some embodiments, the actuator 281 is configured to push the absorber 264 disposed in the recess 266 out of the recess 266, such that the absorber 264 may fall from the drum 206 into a receptacle 280. As such, it may be satisfactory for the actuator 281 to push the absorber 264 out of the recess 266 when the recess 266 is positioned directly above the receptacle 280 and at the bottom of the drum 206 so that the absorber 264 may fall unimpeded into the receptacle 280. Used absorbers 288 are shown as being disposed in the receptacle 280.

Figure 3:
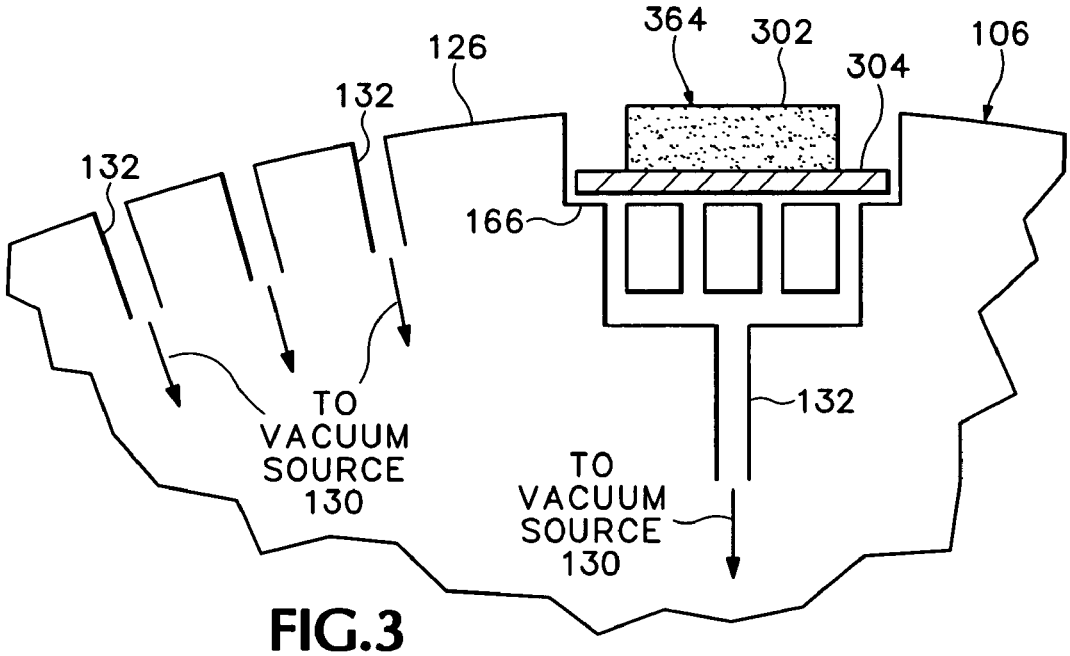
FIG. 3 illustrates a portion of the imaging device of FIG. 1 in accordance with another example embodiment.

FIG. 3 illustrates an absorber 364 on a portion of the drum 106 of the imaging device 100 of FIG. 1 in accordance with another example embodiment. The absorber 364 is shown as comprising an absorbent member 302 disposed on a base 304. The absorbent member 302 may be formed of any of a variety of suitable absorbent or wicking materials. The base 304 may comprise, in this example embodiment, a substantially non-porous member. The base 304 in this example embodiment may also be substantially non-absorbent. As such, as suction force is applied to a bottom surface of the base 304 through the floor of the recess 166, the suction force maintains the absorber 364 within the recess 166. In embodiments where the base 304 is substantially non-porous, the suction force may be greater than in embodiments where the portion of the absorber adjacent the floor of the recess is porous, given a constant vacuum source.

Pursuant to embodiments where the base 304 is substantially non-absorbent, the base 304 may limit or prevent substantial amounts of ink from passing from the absorbent member 302 onto the surfaces of the recess 166 or into the conduits 132. As such, a non-absorbent base 304 may substantially prevent the ink that has been spit onto the absorbent member 302 from leaking or otherwise passing onto drum structures.

Figure 4:
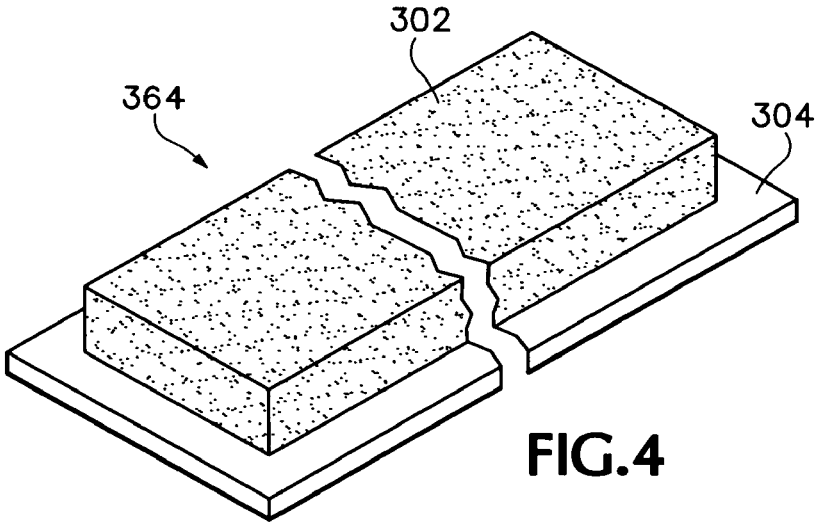
FIG. 4 is a perspective view of the absorber shown in FIG. 3 in accordance with an example embodiment.

FIG. 4 is a perspective view of the absorber 364. In FIG. 4, the absorbent member 302 may comprise an elongated member having a width substantially less than the width of the recess 166 and a length less than the length of the recess 166. The base 304, however, may have a width equal to or slightly less than the width of the recess 166 and length equal to or slightly less than the length of the recess 166. The width of the absorbent member 302 is less than the width of the base 304. The length of the absorbent member 302 is less than the length of the base 304. In some embodiments, the absorbent member 302 has a thickness greater than the thickness of the base 304.

Figure 5:
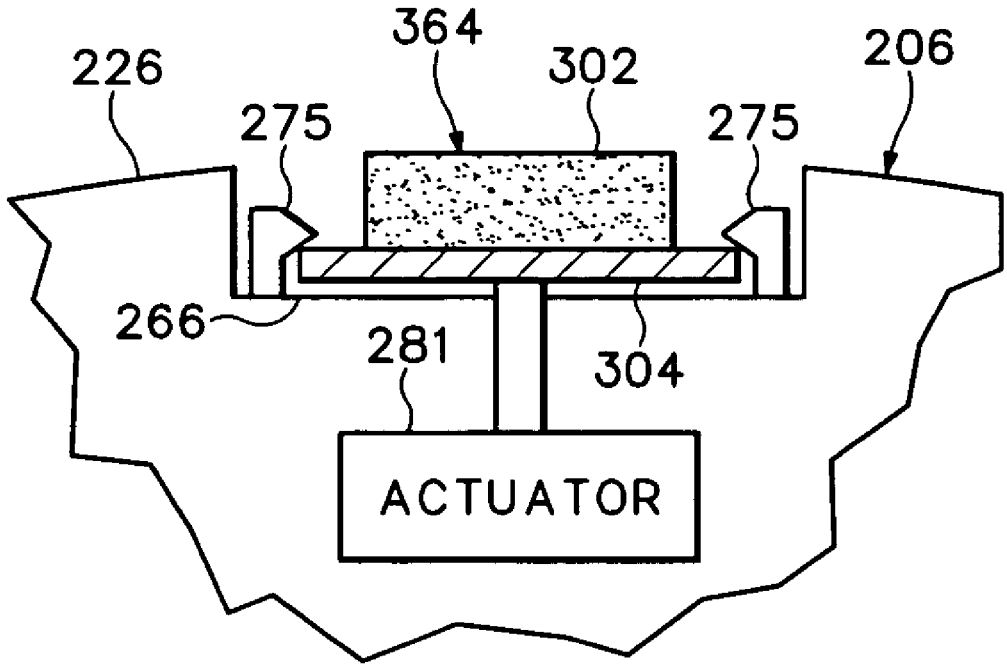
FIG. 5 illustrates a portion of the imaging device of FIG. 2 in accordance with another example embodiment.

FIG. 5 illustrates a portion of the drum 206 of the imaging device 200 of FIG. 2 in accordance with another example embodiment. As shown in this example, the absorber 364 is disposed in the recess 266 and maintained in the recess 266 between grippers 275. In this configuration, the grippers 275 contact the base 304 and do not contact the absorbent member 302, thereby substantially limiting, or preventing, ink disposed in or on the absorbent member 302 from contacting the grippers 275. In other embodiments, however, the grippers 275 may contact the absorbent member.

In this embodiment, the actuator 281 may eject the absorber 364 from within the recess 266, or from the grasp of the grippers 275. The actuator 281 is optional, however, and is not present in some embodiments.

Figure 6:
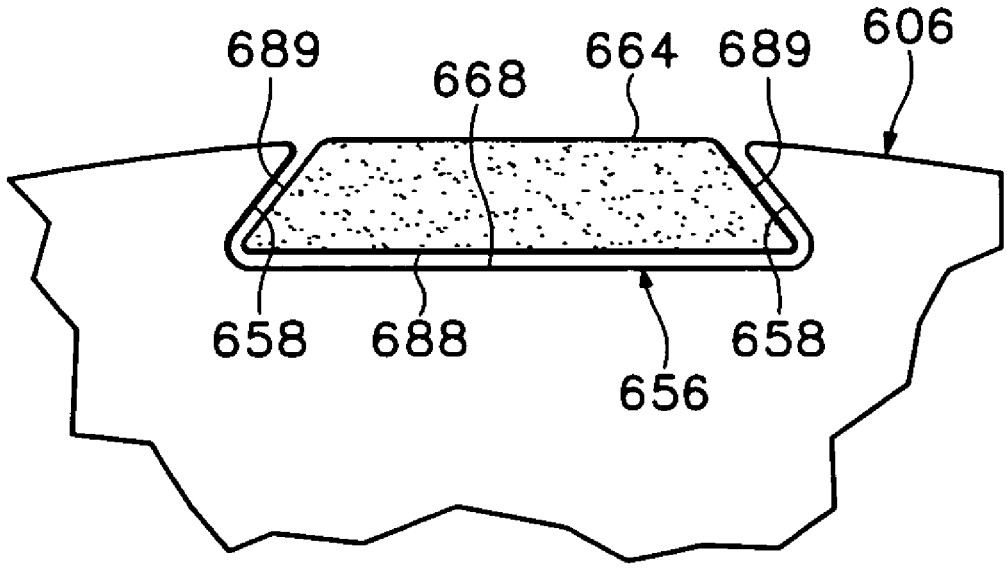
FIG. 6 illustrates a portion of an example drum in accordance with another example embodiment.

FIG. 6 illustrates an example drum 606 in accordance with yet another embodiment. In this embodiment, the drum 606 includes a recess 656 defined by side walls 658 and bottom surface 668. An absorber 664 is positioned within the recess and has a bottom surface 688 and sidewalls 689. In this configuration, the absorber 664 is secured within the recess 656 by a dovetail joint. Other dovetail joint configurations may also be used, such as having a projection (not shown) that extends from the absorber 664 into a corresponding cavity (not shown) in a sidewall 658 or the bottom surface 668.

In some embodiments, the absorber 664 may be manually secured within the recess 656 and maintained in the recess 656 without use of suction force, adhesion, or grippers. Instead, the absorber 664 is held in the recess 656 by virtue of the interlocking or engaging respective geometries of the absorber 664 and recess 656.

Figure 7:
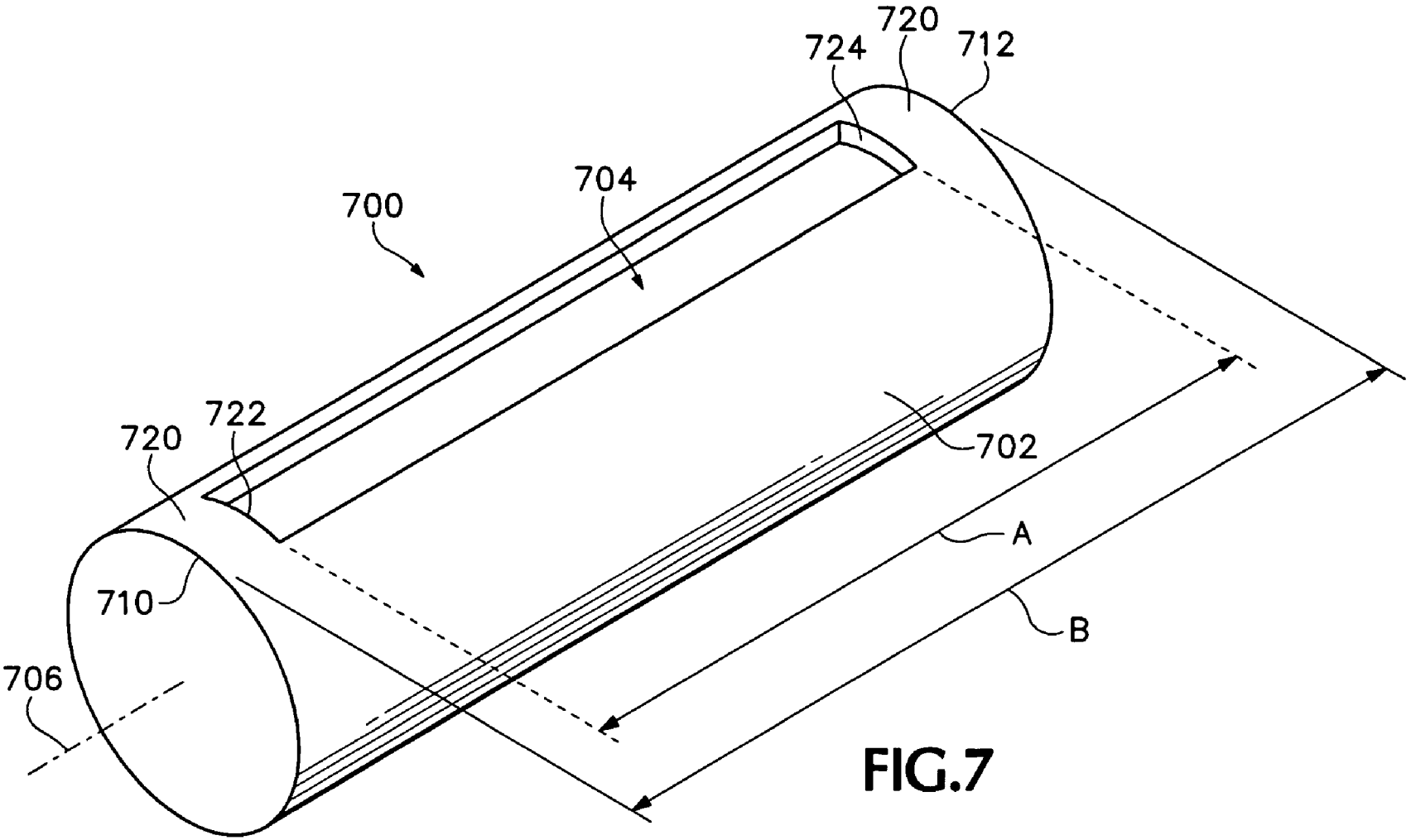
FIG. 7 illustrates an example drum in accordance with yet another example embodiment.

FIG. 7 illustrates an example drum 700 in accordance with an example embodiment. As shown, the drum 700 includes a generally cylindrical outer surface 702 and has a recess 704 formed therein. The recess 704 has a longitudinal axis parallel to an axis of rotation 706 of the drum 700. The longitudinal length A of the recess 704 is less than the longitudinal length B of the drum. The recess 704 does not extend to ends 710, 712 of the drum 700. Rather, portions 720 of the cylindrical outer surface 702 are disposed between ends 722, 724 of the recess 704 and the ends 710, 712 of the drum 700. In some embodiments, the drums of FIGS. 1 and 2 are configured identical or similar to the drum 700.

Although the foregoing has been described with reference to exemplary embodiments, those skilled in the art will recognize that changes may be made in form and detail without departing from the spirit and scope thereof. For example, although different exemplary embodiments may have been described as including one or more features providing one or more benefits, it is contemplated that the described features may be interchanged with one another or alternatively be combined with one another in the described exemplary embodiments or in other alternative embodiments. The present inventions described with reference to the exemplary embodiments and set forth in the following claims are manifestly intended to be as broad as possible. For example, unless specifically otherwise noted, the claims reciting a single particular element also encompass a plurality of such particular elements.

What is claimed is:

1. An imaging device, comprising:

a drum platen having a recess;

a loading mechanism for loading an absorber into the recess;

a pen configured to eject ink on the absorber while the absorber is in the recess.

2. The imaging device of claim 1, further comprising an unloading mechanism for unloading an absorber from the recess.

3. The imaging device of claim 1, further comprising a plurality of absorbers accessible to the loading mechanism for loading into the recess.

4. The imaging device of claim 1, further comprising a receptacle for receiving the absorber after being unloaded from the recess.

5. The imaging device of claim 1, wherein the absorber is at least partially disposed on a bottom surface of the recess.

6. The imaging device of claim 1 further comprising a vacuum source coupled to a surface of the recess to maintain the absorber in the recess at least partially by suction.

7. The imaging device of claim 1, wherein the absorber is maintained in the recess by adhesion.

8. The imaging device of claim 1, further comprising one or more retaining members disposed on the drum for maintaining the absorber in the recess.

9. The imaging device of claim 1, further comprising an actuator disposed in the drum for advancing the absorber from the recess.

10. The imaging device of claim 1, further comprising:

a media input tray;

an absorber input tray having absorbers disposed therein;

wherein the loading mechanism is configured to load media from the media input tray onto the drum and also configured to load at least one of the absorbers from the absorber input tray.

11. The imaging device of claim 1, further comprising a magazine having absorbers disposed therein and configured to advance at least one of the absorbers into the recess.

12. The imaging device of claim 1, further comprising a receptacle having at least one ink-soiled absorber disposed therein.

13. The imaging device of claim 1, further comprising a receptacle for receiving the absorber after being unloaded from the recess, the receptacle being in spaced relation from the drum.

14. The imaging device of claim 1, wherein the absorber comprises:

a non-absorbent substrate;

an absorbent member disposed on the substrate.

15. The imaging device of claim 1, wherein the absorber comprises a fibrous material.

16. The imaging device of claim 1, wherein the loading mechanism is disposed outside of the drum platen.

17. The imaging device of claim 1, wherein the drum has an axial length and the recess has a longitudinal length, the axial length of the drum being greater than the longitudinal length of the recess.

18. The imaging device of claim 1, wherein the recess has an opening and a bottom surface, the bottom surface being wider than the opening.

19. The imaging device of claim 1, further comprising:

one or more retaining members disposed in the recess;

an absorber comprising an absorbent member on a non-absorbent substrate, wherein the retaining members contact the non-absorbent substrate and do not contact the absorbent member.

20. An apparatus, comprising:

an inkjet print engine;

a drum adjacent the inkjet print engine, the drum configured to advance media relative to the inkjet print engine;

a groove formed in the drum, the groove having a bottom surface;

a disposable on the bottom surface, the disposable having a first layer and a second layer, the second layer formed of an absorbent material, the first layer positioned on the bottom surface of the groove.

21. The apparatus of claim 20, wherein the first layer is formed of a non-absorbent material.

22. The apparatus of claim 20, wherein the first layer is formed of a non-porous material.

23. The apparatus of claim 20, further comprising grippers mounted on the drum and configured to grip the first layer of the disposable.

24. The apparatus of claim 20, further comprising a magazine having multiple disposables therein and configured to advance individual ones of the disposables into the groove.

25. The apparatus of claim 20, further comprising a container spaced from the drum in the direction of gravity such that the disposable may fall from the drum into the container.

26. The apparatus of claim 20, further comprising:

a first and second trays;

a media handling assembly configured to selectively pick from the first or the second tray and to advance an item picked to the drum;

wherein the second tray has a plurality of disposables therein.

27. The apparatus of claim 26, wherein the first tray is configured to store sheets of paper therein.

28. A device, comprising:

an inkjet print engine;

a cylinder having a channel formed therein, the cylinder configured to advance media adjacent the inkjet print engine;

means for loading an absorber into the channel.

29. The device of claim 28, further comprising means for unloading the absorber from the channel.

30. A method, comprising:

loading an absorber onto a drum using a loader;

loading media onto the drum using the loader;

printing on the media;

ejecting ink onto the absorber;

unloading the absorber from the drum after a predetermined amount of ink has been ejected onto the absorber.

31. The method of claim 30, further comprising maintaining the absorber on the drum by suction.

32. The method of claim 30, further comprising maintaining the absorber on the drum by adhesion.

33. The method of claim 30, further comprising gripping the absorber at the drum.

34. The method of claim 30, wherein the absorber comprises first and second layers, the method further comprising gripping the second layer without gripping the first layer.

35. The method of claim 30, wherein the unloading comprises reducing an amount of suction on the absorber.

36. The method of claim 30, wherein the unloading comprises pushing the absorber away from the drum.

37. The method of claim 30, further comprising permitting the absorber to fall under influence of gravity from the drum into a receptacle.

38. The method of claim 30, further comprising empting the receptacle after a predetermined number of absorbers have been deposited therein.

* * * * *